US006282867B1

(12) United States Patent
Focke et al.

(10) Patent No.: US 6,282,867 B1
(45) Date of Patent: Sep. 4, 2001

(54) METHOD AND APPARATUS FOR HANDLING REELS

(75) Inventors: Heinz Focke, Verden; Harald Freudenberg, Marklohe, both of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/031,957

(22) Filed: Feb. 26, 1998

(30) Foreign Application Priority Data

Mar. 14, 1997 (DE) ..... 197 10 657

(51) Int. Cl.[7] ..... B06B 43/26
(52) U.S. Cl. ..... 53/381.4; 53/492; 414/412
(58) Field of Search ..... 53/492, 381.2, 53/381.4; 414/412, 411, 352, 541

(56) References Cited

U.S. PATENT DOCUMENTS

| | | | | |
|---|---|---|---|---|
| 5,060,456 | * | 10/1991 | Wehrli | 53/492 |
| 5,306,111 | * | 4/1994 | Higashiura | 414/416 |
| 5,462,165 | * | 10/1995 | Thuer | 53/492 |
| 5,752,359 | * | 5/1998 | Oord | 53/381.2 |

FOREIGN PATENT DOCUMENTS

| | | | | |
|---|---|---|---|---|
| 3936829 | | 8/1991 | (DE) . | |
| 4236691 | | 5/1994 | (DE) . | |
| 4310675A1 | | 6/1994 | (DE) . | |
| 618160 | | 10/1994 | (EP) . | |
| 2295807 | | 6/1996 | (GB) . | |
| 0307030 | * | 12/1988 | (JP) | 53/381.2 |
| 0139323 | * | 5/1989 | (JP) | 53/381.2 |
| 201829 | * | 7/1992 | (JP) | 53/492 |
| 213326 | * | 8/1993 | (JP) | 53/381.2 |

* cited by examiner

*Primary Examiner*—Eugene Kim
(74) *Attorney, Agent, or Firm*—Abelman, Frayne & Schwab

(57) ABSTRACT

A method and apparatus for opening an outer wrapping (11) of a reel (10) of, in particular, packaging material For the provision of a reel (10) of, for example, packaging material, such as paper, tinfoil or the like, it is necessary to remove an outer wrapping (11). The latter usually consists of an outer wound layer of the material. To open the wrapping (11), a material strip, namely an opening strip (32) is torn out of the wrapping (11). For this purpose, a tear-off member, namely a tear-off band (35), is placed with strong adhesion against the outside of the reel (10), On account of the relative movement, the opening strip (32) is torn out of the wrapping (11).

5 Claims, 5 Drawing Sheets

METHOD AND APPARATUS FOR HANDLING REELS

DESCRIPTION

The invention relates to a method and an apparatus for preparing reels made of wound webs of material, such as paper, tinfoil or film, by removing or opening a closed outer wrapping.

The reels referred to are mainly reels of packaging material. In packaging technology, thin packaging material, for example of paper, tinfoil, foil etc., is provided as a reel, that is to say, as a wound continuous web. The reels have to be prepared for processing within the packaging machine. This includes opening or removing an outer wrapping which holds the reel together before it is put to use. This outer wrapping is predominantly an outer wound layer of the material of the reel itself, that is to say, the end piece of the material web. This is usually joined to the following layer by bonding.

The invention is based on the object of proposing measures for the preparation or provision of reels, in particular in conjunction with packaging machines, so that the reels are ready for use when the outer wrapping has been opened or removed.

To achieve this object, the method according to the invention is characterized in that a/(an) (opening) strip is separated from the wrapping in the axial direction.

The opening strip is separated, in particular torn out, from the wrapping at any desired place transversely to the circumferential direction. The wrapping is thus interrupted. The beginning of the material web thus formed can be gripped in order to pull out the latter.

The opening strip is separated by a tear-off member which grips a strip-like region of the wrapping and, as a result of the relative movement, separates it as an opening strip. The tear-off member is preferably provided with an adhesive, bonding surface which comes to rest against the circumference of the reel and thus against the outer wrapping and, as a result of the connection and the subsequent relative movement, carries out the tear-off operation.

Another special feature of the apparatus is the formation of a magazine for accommodating a plurality of reels. According to the invention, these reels are positioned within the magazine at a distance from one another and lie with their circumferential surfaces on bearing elements located at the corresponding positions, preferably on a carriage which can be driven in the longitudinal direction of the magazine, each carriage transporting one reel within the magazine.

The arrangement of the reels at an (axial) direction from one another has the advantage that any mutual influence or impediment, in particular involving the sensitive side surfaces of the reels, is thereby avoided.

Figure 1:
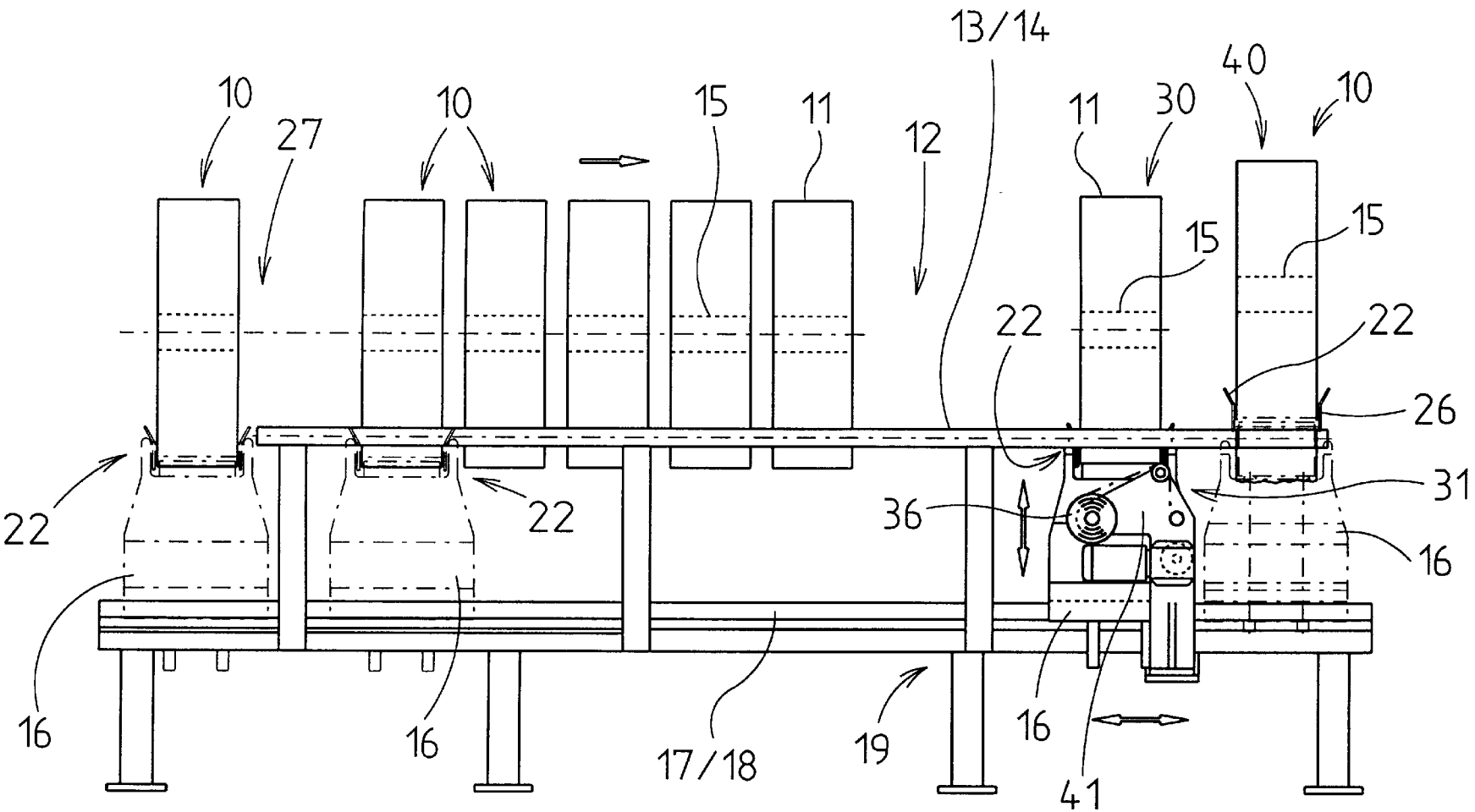

Further details of the invention relate to the design and mode of operation of the apparatus for opening reels. An exemplary embodiment of the apparatus for the opening of reels and of the magazine is described below with reference to the drawings. It shows:

FIG. 1 a side view of an apparatus for preparing reels.

Figure 2:
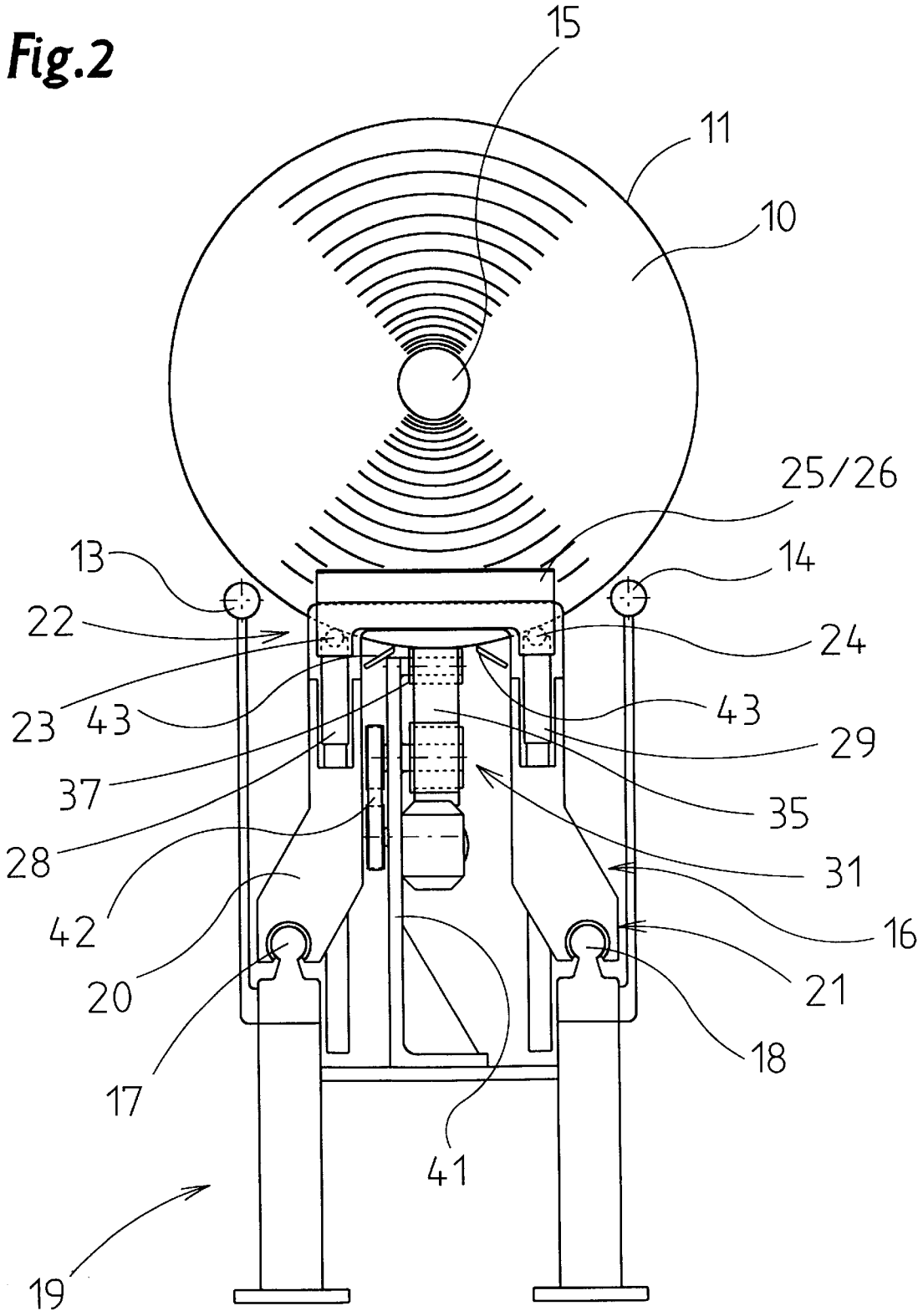
Figure 3:
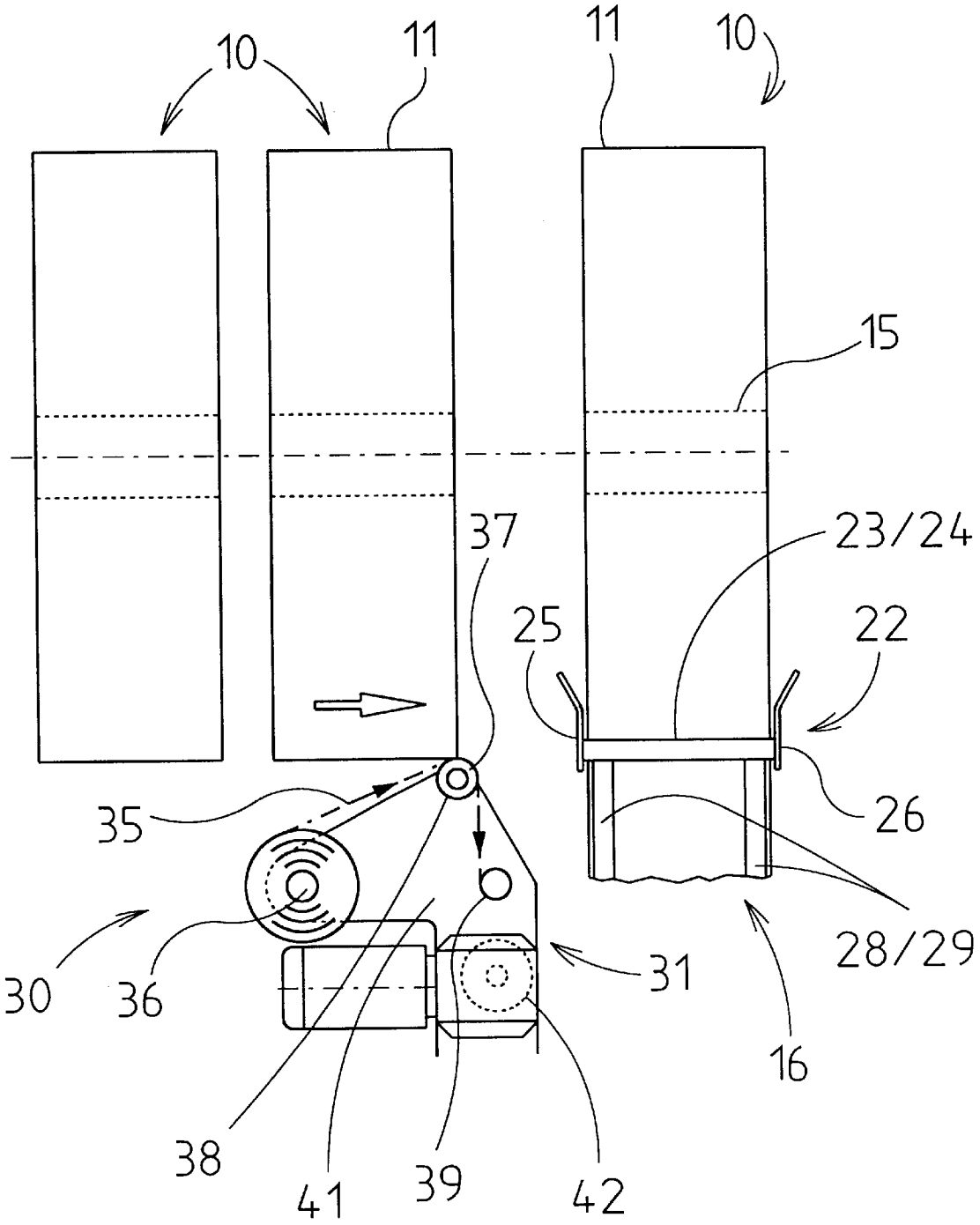
Figure 7:
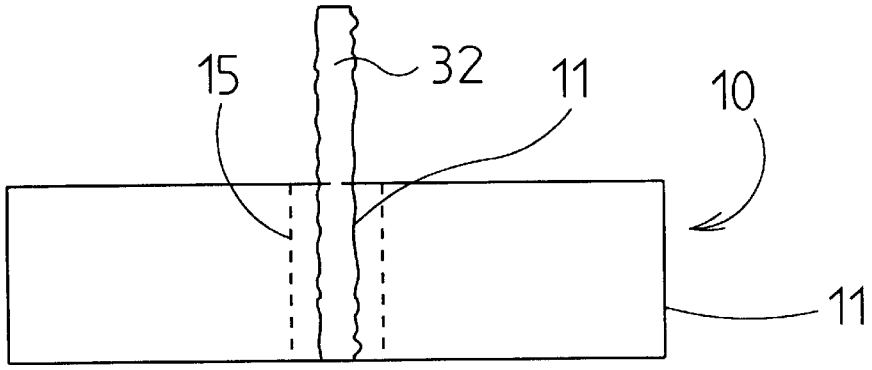
Figure 4:
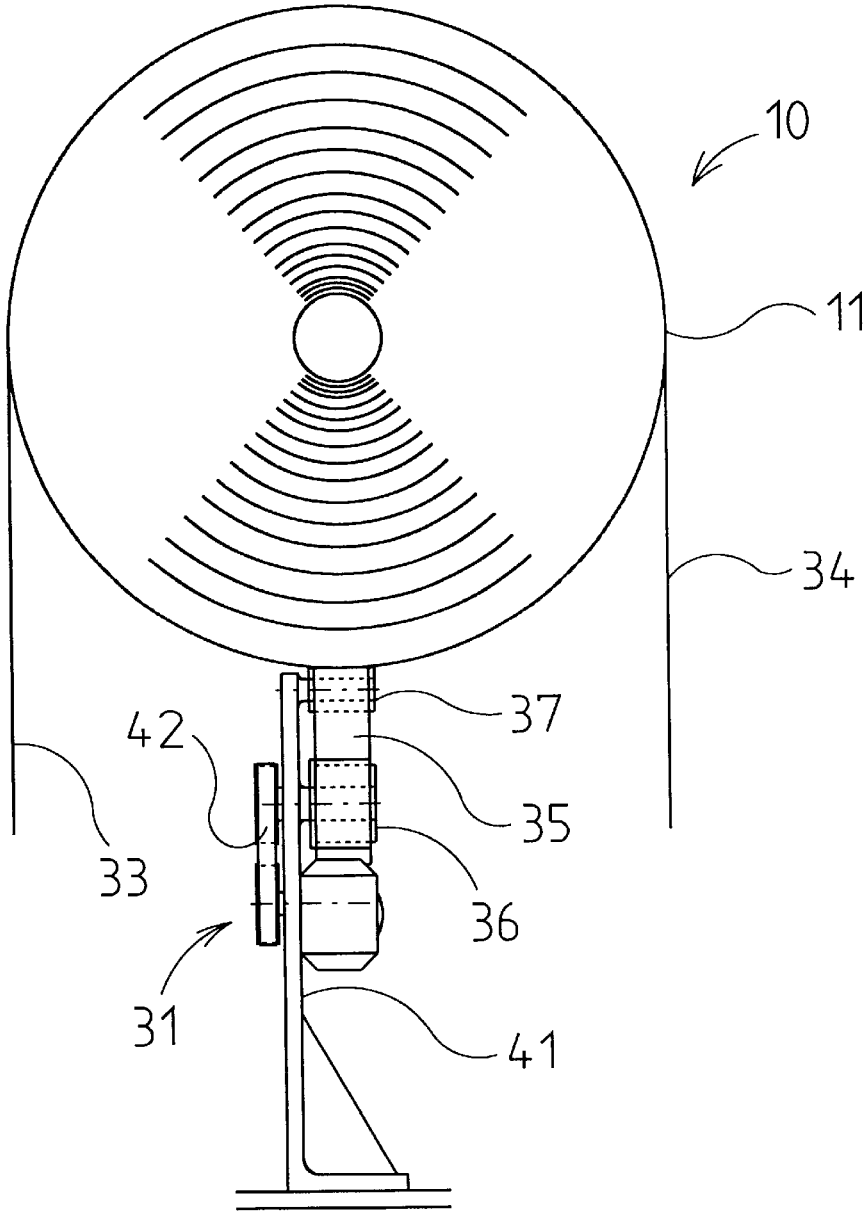
Figure 5:
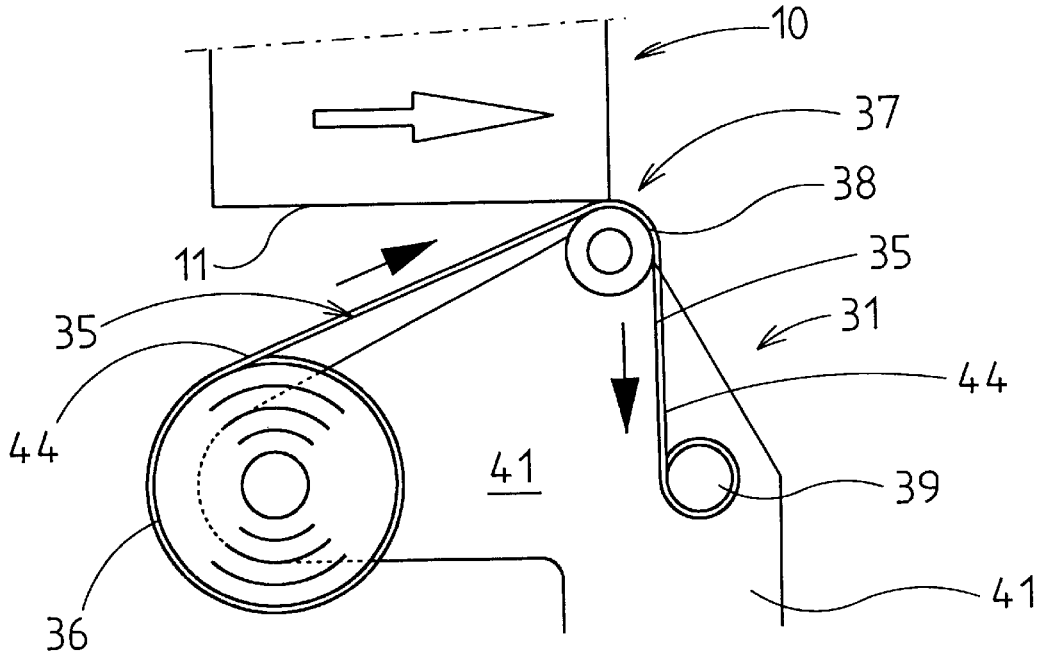
Figure 6:
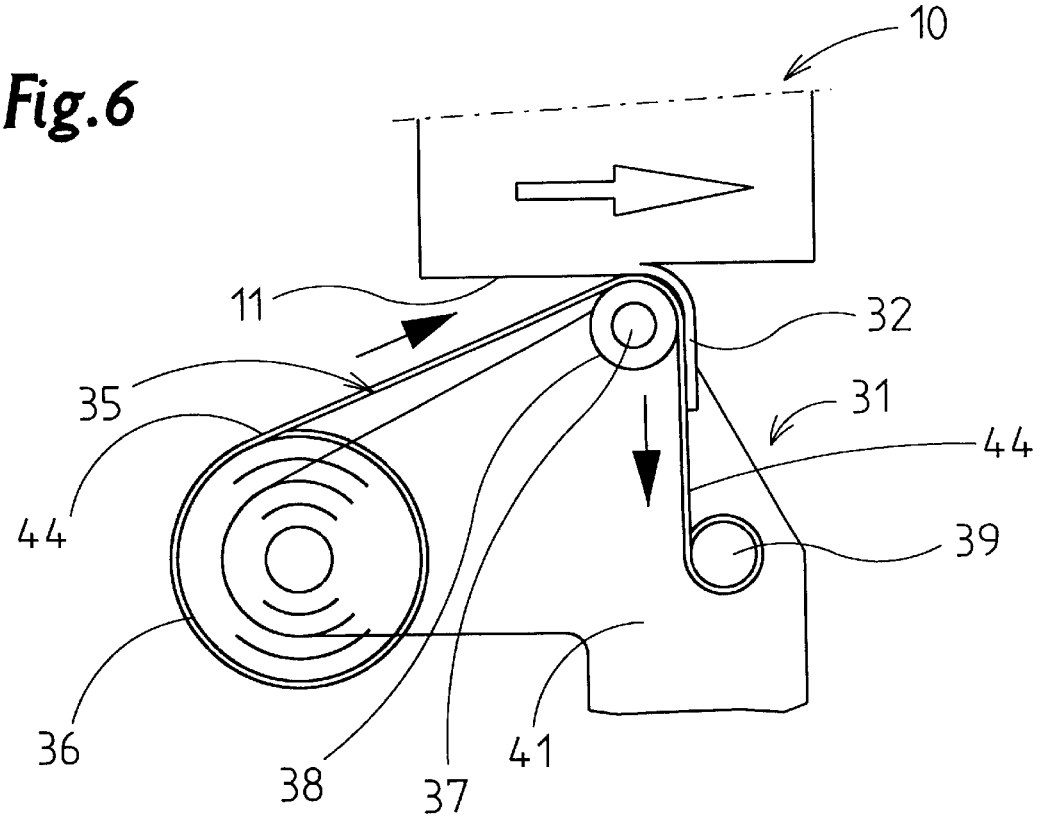

FIG. 2 a transverse view of an opening station for reels, on an enlarged scale, FIG. 3 a detail of the apparatus, namely the opening station, in a side view and likewise on an enlarged scale, FIG. 4 a transverse view relative to FIG. 3, FIG. 5 an illustration of a part of a reel at the beginning of the opening operation, FIG. 6 an illustration similar to FIG. 5 during the opening operation, FIG. 7 a view of a partial region of the circumferential surface of a reel after the latter has been opened, on an enlarged scale.

The device shown in FIG. 1 is primarily suitable for packaging technology, that is to say in conjunction with a packaging machine (not shown). It concerns the storage, handling and preparation of reels 10 for processing and for the packaging process. The reels 10 are wound webs of thin material, in particular packaging material, such as paper, tinfoil, film or the like. The reel 10 is held in the closed position by an outer wrapping 11. The wrapping 11 is usually formed by the material web itself. Its outer end is joined to the adjacent layer by bonding or by an adhesive strip, as a result of which the outer closed wrapping 11 is produced. Said wrapping has to be opened or removed for the reel 10 to be put to use.

In the exemplary embodiment of FIG. 1, as shown, a plurality of reels 10 are located in a specially designed store or magazine 12. In the latter, the reels 10 are positioned spaced apart axially from one another on a holder, namely on (two) parallel bearing rods 13, 14 arranged spaced apart from one another. The reels 10 rest with a bottom circumferential region on the bearing rods 13 extending with appropriate spacing from one another. Central openings 15 in the reels 10 are arranged equiaxially.

The reels 10 are fed to the magazine 12 by a special conveying member and transported by said conveying member in the region of the magazine 12. Said conveying member is a (or more than one) carriage 16. The latter can be moved between the bearing rods 13, 14 or below the latter.

The carriage 16 is mounted on guides, specifically on sliding rails 17, 18 which are arranged on a supporting structure 19 below and parallel to the bearing rods 13. The carriage 16 is mounted in a sliding manner on the rod-like sliding rails 17, 18 with two slides 20, 21 arranged spaced apart from one another.

The carriage 16 is provided with receptacles 22 for picking up and handling one reel 10 in each case. There are, on the one hand, axially parallel bearing rods 23, 24. Resting on these with its circumferential surface is the reel 10 picked up by the carriage 16 in each case. Moreover, lateral guides 25, 26 are provided which, as part of the receptacle 22, support the reel 10 on the upright lateral surfaces. The lateral guides 25, 26, configured as transversely disposed walls, are widened upwards in a funnel shape, so that the reel 10 is centered when it is introduced into the receptacle 22 of the carriage 16.

The (reel) receptacle 22 of the carriage 16, comprising the bearing rods 23, 24 and the lateral guides 25, 26 in the present example, can be moved up and down in order to pick up or set down a reel 10. In the present example, the reels 10 are supplied individually in the region of a transfer station 27, for example by means of an overhead conveyor. In this case, the respective reel 10 is inserted from above into the receptacle 22, namely placed on the bearing rods 23, 24. The transfer station 27 is located outside the bearing rods 13, 14. The carriage 16 is then moved in the longitudinal direction of the bearing rods 13, 14 until the respective reel can be set down on the bearing rods 13, 14, specifically by moving the receptacle 22 downwards.

The carriage 16 also carried out the further transportation of the reels 10 within the magazine 12. In this case, the receptacle 22 is moved up and down accordingly to receive and pass on a reel 10. For this purpose, the receptacle 22 is mounted on supporting rods 28, 29 or arranged thereon. The supporting rods 28, 29 are mounted in guides in the vertical direction, specifically in each case in one of the slides 20, 21 of the carriage 16. The supporting rods 28, 29 can be moved in the vertical direction by means of a suitable drive, for example by a toothed-rack transmission or by a pressure-medium cylinder. The lower end position is illustrated by dotted lines in FIG. 2.

The reels 10 are prepared for processing, namely opened in the region of the wrapping 11, in an opening station 30. The opening station 30 is integrated into the magazine 12.

For opening, the reel 10 is picked up by the carriage 16 and moved through the opening station 30. On account of the relative movement, an opening assembly 31 in the opening station 30 automatically becomes active. The opening assembly 31 separates a strip, namely an opening strip 32, from the wrapping 11, so that the latter is severed. The outer wrapping 11 then hangs with free limbs 33, 34 down at the sides of the circumference of the reel 10. When the reel 10 is put to use, one of the limbs 33, 34 is gripped for the purpose of pulling out the web.

The opening assembly 31 is provided with a tear-off member, which picks up the wrapping 11 on the outside and, due to the relative movement, tears the opening strip 32 out of the wrapping 11. In this case, the wrapping 11 consists of tearable material, such as paper, tinfoil or the like. In the present exemplary embodiment, the relative movement of the reel 10 is achieved by the carriage 16 moving the respective reel 10 past the stationary tear-off member. The latter is provided on the side facing the circumference of the reel 10 with an adhesive agent, for example a (strong) bonding agent which, as a result of the bonding to the wrapping 11, separates the adhering region, that is to say the opening strip 32.

In the present case, the tear-off member is a/(an) (endless) tear-off band 35. This is drawn in cycles or sections from a roll 36. A section of the tear-off band 35 corresponding to the axial dimension of the reel 10 is pressed with a bonding surface arranged on the facing side against the wrapping 11 and bonded thereto. For this purpose, the tear-off band 35 is conducted over a nipping roller 37 which presses the respective section of the tear-off band 35 against the reel 10. In this case, the tear-off band 35 is moved in the region of the nipping roller 37 at a (circumferential) speed which corresponds to the conveying speed of the reel 10. The nipping roller 37 consists of elastic material or is provided with an elastic jacket 38.

On account of the adhesive bonding to the wrapping 11, the tear-off band 35 separates the opening strip 32 from the wrapping 11. The opening strip 32 remains joined to the tear-off band 35 and is conveyed away with the latter. In the present example, the tear-off band 35 is taken up by a collecting roll 39. The latter is driven in rotation, but with a small torque, thus preventing the tear-off band 35 from being torn off.

When processing webs consisting of a material more resistant to tearing, such as films, the tear-off operation or the separation of the opening strip 32 is supported by supplementary elements which lie on the circumference of the reel 10 and determine the tear line. In the present exemplary embodiment, these elements are (two spaced-apart) tear-off edges 43 positioned at an angled position on both sides of the tear-off band 35 at the opening assembly 31. When the opening assembly is lifted, the tear-off edges 43 come to rest on the circumference of the reel 10. Scarped borders or edges support the tear-off operation.

The reel 10, which is now open, is fed to a transfer station 40 by the carriage 16. The reel 10 then passes, for example, into the splicing station in order to be connected to the trailing end of a material web.

The opening station 30 or the opening assembly 31 assumes a stationary position and is connected to the supporting structure 19. The opening assembly 31 lies approximately centrally between the bearing rods 13, 14. An upright bearing wall 41 holds the tear-off band 35 with the roll 36, nipping roller 37 and collecting roll 39 on one side. The drive for the collecting roll 39, namely a belt drive 42, is provided on the opposite side. The carriage 16 is of U-shaped design, so that the carriage 16 can be moved smoothly through the opening station 30 and past the opening assembly 31. Alternately, the opening assembly 31 can be portable or can be advanced to a reel 10.

The carriage 16 can be driven in a suitable manner in the longitudinal direction of the magazine 12. For example, a (commercially available) linear unit may be assigned as a drive member to the carriage or a likewise commercially available cylinder without a piston rod (not shown). The magazine 12, designed according to the present description, can also be employed independent of the opening assembly 31.

What is claimed is:

1. Apparatus for preparing reels (10) made of axially directed webs of tearable packaging material, by opening a closed outer wrapping (11), characterized by the following features:

a) attaching an opening assembly (31) to the outer wrapping (11) of the reel (10), b) providing the opening assembly (31) with a tear-off band (35), which grips the outer wrapping (11) by means of adhesive bonding to its outer side and including an opening strip (32), c) the tear-off band (35) extends across the wrapping (11) transverse thereto, d) the tear-off band being movable in a direction parallel to the axis of the reel (10) or transverse to the wrapping (11) while maintaining the adhesive bond to the wrapping (11) by starting at one edge of the latter and moving to the opposite edge, for separating the opening strip (32) from the wrapping (11) due to the adhesive bond.

2. Apparatus according to claim 1, characterized in that the tear-off band (35) of the opening assembly (31) is a band which can be pressed, with one side facing the reel (10) and having a bonding agent (44), against the outer surface or wrapping (11) of the reel (10) in such a way that the tear-off band (35) is locally bonded to the wrapping (11), and that, due to the relative movement, the opening strip (32) can be separated from the wrapping (11) by the tear-off band (35).

3. Apparatus according to claim 2, characterized in that the tear-off band can be pressed against the circumference or the wrapping (11) of the reel by means of an elastic nipping roller (37), and in that the tear-off band (35)—with the opening strip (32)—can be wound onto a collecting roll (39).

4. Apparatus according to claim 1, characterized by the following features:

a) the opening station (30) is integrated into a magazine (12) for a plurality of reels (10), b) the reels (10) are positioned along a horizontal orientation of the reel axis and horizontally spaced from each other, c) each individual reel (10) can be conveyed by a carriage (16) in the longitudinal direction of the magazine (12), and d) the reels (10) lie with their circumferential surface on a receptacle (22) of the carriage (16).

5. Apparatus according to claim 1, characterized by the following features:

a) during opening of the outer wrapping (11), each reel (10) is moved individually through an opening station (30), b) the opening assembly (31) in the opening station (30) assumes a fixed position such that the reels (10) conveyed through the opening station (30) in the region of the opening assembly (31) lie with the outer side wrapping (11) against the tear-off band (35) to permit the opening strip (32) to be separated from the wrapping (11) as a result of the movement of the reel (10) relative to the opening assembly (31).

* * * * *

UNITED STATES PATENT AND TRADEMARK OFFICE

CERTIFICATE OF CORRECTION

PATENT NO. : 6,282,867 B1
DATED : September 4, 2001
INVENTOR(S) : Heinz Focke et al.

It is certified that error appears in the above-identified patent and that said Letters Patent is hereby corrected as shown below:

Claims 4 and 5,
From column 4, line 61, to column 6, line 8, replace the present text with the following:

-- 4. Apparatus according to claim 1, characterized by the following features:

a) during opening of the outer wrapping (11), each reel (10) is moved individually through an opening station (30), b) the opening assembly (31) in the opening station (30) assumes a fixed position such that the reels (10) conveyed through the opening station (30) in the region of the opening assembly (31) lie with the outer side of their wrapping (11) against the tear-off band (35) to permit the opening strip (32) to be seperated from the wrapping (11) as a result of the movement of the reel (10) relative to the opening assembly (31).

5. Apparatus according to claim 4, characterized by the following features a) the opening station (30) is integrated into a magazine (12) for a plurality of reels (10), b) the reels (10) are positioned along a horizontal orientation of the reel axis and horizontally spaced from each other, c) each individual reel (10) can be conveyed by a carriage (16) in the longitudinal direction of the magazine (12), and d) the reels (10) lie with their circumferential surface on a receptacle (22) of the carriage (16). --

Signed and Sealed this

Ninth Day of April, 2002

*Attest:*

*Attesting Officer*

JAMES E. ROGAN
*Director of the United States Patent and Trademark Office*